US007413449B1

(12) United States Patent
Su et al.

(10) Patent No.: US 7,413,449 B1
(45) Date of Patent: Aug. 19, 2008

(54) PLUGGABLE INSULATED TERMINAL BLOCK

(75) Inventors: Hou-An Su, Keelung (TW); You-Hua Cai, Zijin County (CN)

(73) Assignee: Nextronics Engineering Corp., Taipei (TW)

( * ) Notice: Subject to any disclaimer, the term of this patent is extended or adjusted under 35 U.S.C. 154(b) by 0 days.

(21) Appl. No.: 11/979,287

(22) Filed: Nov. 1, 2007

(51) Int. Cl.
*H01R 12/00* (2006.01)

(52) U.S. Cl. ..... 439/79

(58) Field of Classification Search ..... 439/79, 439/942, 943

See application file for complete search history.

(56) References Cited

U.S. PATENT DOCUMENTS 5,433,624 A * 7/1995 Tabata ..... 439/79
5,785,537 A * 7/1998 Donahue et al. ..... 439/79
6,183,270 B1 * 2/2001 Huang et al. ..... 439/79
6,210,180 B1 * 4/2001 Lee et al. ..... 439/79
6,604,952 B2 * 8/2003 Miwa et al. ..... 439/79

* cited by examiner

*Primary Examiner*—Tho D Ta
(74) *Attorney, Agent, or Firm*—Rosenberg, Klein & Lee

(57) ABSTRACT

An improved pluggable insulated terminal block includes a terminal block and a plurality of terminal-protecting pieces. The terminal block comprises a first cover, a second cover and a plurality of terminals. An inner wall of the first cover is provided with a plurality of first terminal holders. An inner wall of the second cover is provided with a plurality of second terminal holders. Each terminal penetrates through one of the first terminal holders and one of the second terminal holders. The first cover is connected with the second cover. The terminal-protecting pieces are provided between the first terminal holders and the second terminal holders. The terminal-protecting pieces are arranged on the terminals. The two ends of each terminal extend beyond the terminal-protecting piece. Via this arrangement, the terminals will not be pushed inside the terminal block, when the terminals are inserted into a circuit board.

5 Claims, 6 Drawing Sheets

PLUGGABLE INSULATED TERMINAL BLOCK

BACKGROUND OF THE INVENTION

1. Field of the Invention

The present invention relates to an improved pluggable insulated terminal block, and in particular to an insulated terminal block having a terminal-protecting assembly.

2. Description of Related Art

Shown in FIG. 1, is a conventional pluggable insulated terminal block, well known in the industry, which comprises a first cover 1*a*, a second cover 2*a* and a plurality of terminals 3*a*. The first cover 1*a* and the second cover 2*a* are engaged with each other. The inner walls of the first cover 1*a* and the second cover 2*a* are provided with a plurality of terminal holders 4*a*. Each terminal holder 4*a* is provided with a plurality of terminal-accommodating through holes 41*a*. The terminal 3*a* is inserted into the terminal-accommodating holes 41*a*, and both ends of the terminal 3*a* extend beyond the terminal-accommodating holes 41*a*. When the terminal 3*a* is inserted into a circuit board, the terminal 3*a* will be subjected to a pushing force exerted by the circuit board. If the fit between the terminal 3*a* and the first and second cover 1*a*, 2*a* is insufficient, the terminal 3*a* is often pushed through the terminal-accommodating holes 41*a* into the terminal block, causing a loss of functionality and thus a reduction in production yield for the circuit board assembly.

Therefore, in view of the above drawbacks, the inventor proposes the present invention to overcome the above problems based on his deliberate research.

SUMMARY OF THE INVENTION

In view of the above problems, the object of the present invention is to provide an improved pluggable insulated terminal block, which has the effect of improving the production yield.

In order to achieve the above object, the present invention provides an improved pluggable insulated terminal block, which includes a pluggable terminal block comprising a first cover, a second cover and a plurality of terminals, an inner wall of the first cover being provided with a plurality of first terminal holders, each first terminal holder being provided with a plurality of first terminal-accommodating through holes, an inner wall of the second cover being provided with a plurality of second terminal holders, each second terminal holder being provided with a plurality of second terminal-accommodating through holes, the second terminal holders corresponding to the first terminal holders, each terminal penetrating through the first terminal-accommodating hole and the second terminal-accommodating hole, the first cover being connected with the second cover; and a plurality of terminal-protecting pieces, the terminal-protecting pieces being provided between the first terminal holders and the second terminal holders, the terminal-protecting pieces being arranged on the terminals, the two ends of the terminals extending beyond the terminal-protecting pieces.

The present invention has the following effect. When the terminals of the pluggable terminal block are inserted on the circuit board, the terminals are subjected to a pushing force exerted by the circuit board. The pushing force is transmitted through the terminal-protecting pieces into the first cover, and is thus born by the entire terminal block. Therefore, the terminals will not be pushed through the terminal-accommodating holes into the terminal block, and thus the production yield for the circuit board assembly can be improved.

DETAILED DESCRIPTION OF THE PREFERRED EMBODIMENTS

Figure 1:
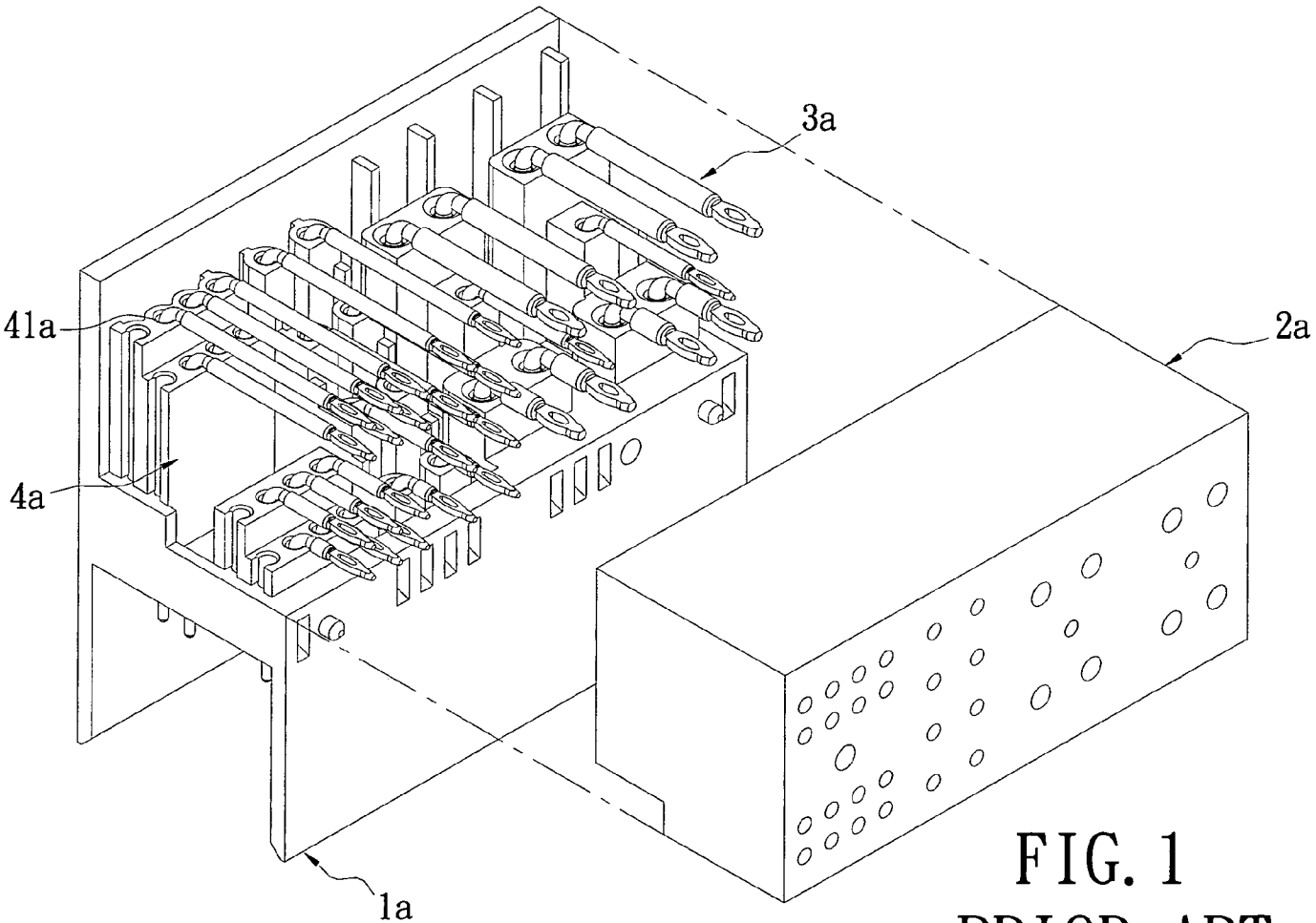
FIG. 1 PRIOR ART
FIG. 1 is an assembled perspective view showing a conventional pluggable insulated terminal block.
Figure 2:
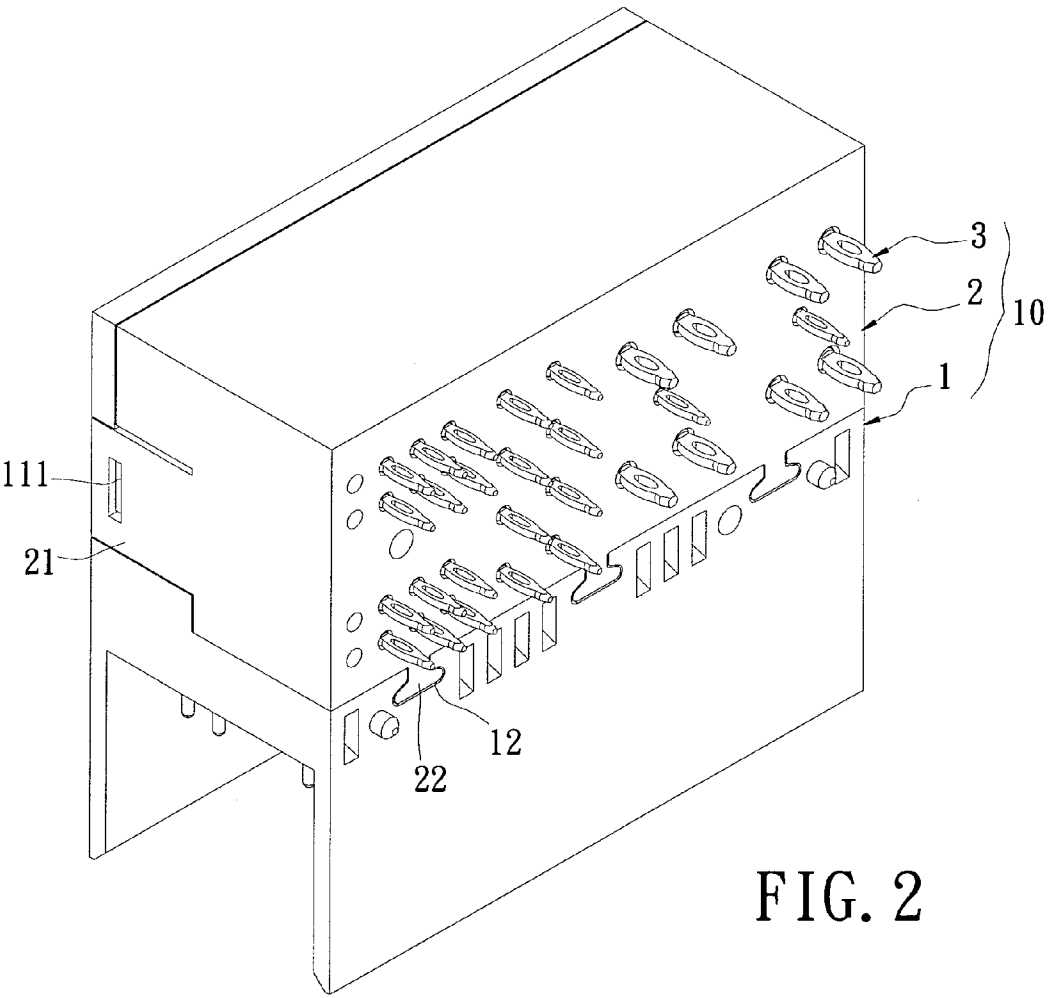
FIG. 2 is an assembled perspective view of the present invention.

Please refer to FIGS. 2 to 5. The present invention provides an improved pluggable insulated terminal block, which includes a terminal block 10 and a plurality of terminal-protecting pieces 4. The terminal block 10 comprises a first cover 1, a second cover 2 and a plurality of terminals 3. Each of two opposing sides of the first cover 1 has a recessed engaging portion 11. Each of the engaging portions 11 is provided with a protruding point 111. A third side of the first cover 1 is provided with a plurality of cavities 12 with a T-shaped cross-section. The inner wall of the first cover 1 is provided with a plurality of first terminal holders 13. The first terminal holders 13 are arranged in a stepped manner. Each first terminal holder 13 is provided with a plurality of first terminal-accommodating through holes 131.

A pair of latches 21 extends outwardly form each of two opposing sides of the second cover 2. The pair of latches 21 is elastic. Each of the pair of latches 21 is provided with a rectangular hole 211. A plurality of protrusions 22 extends from a third side of the second cover 2. The protrusions 22 are arranged on the third side of the second cover 2 at intervals. The protrusions 22 have a T-shaped cross-section. The inner wall of the second cover 2 is provided with a plurality of second terminal holders 23. The second terminal holders 23 are also arranged in a stepped manner, and the second terminal holders 23 correspond to the first terminal holders 13. Each of the second terminal holders 23 is provided with a plurality of second terminal-accommodating through holes 231.

Figure 6:
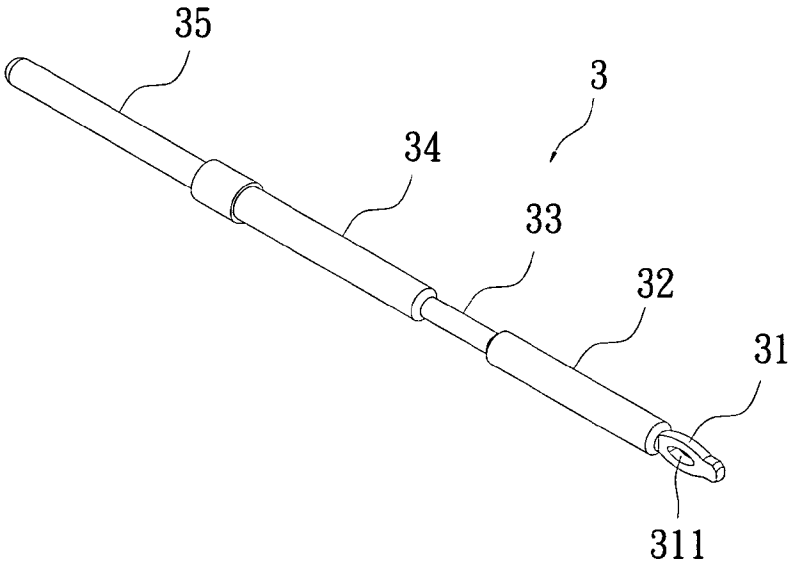
FIG. 6 is a perspective view showing the terminal of the present invention.

As shown in FIG. 6, each terminal 3 comprises a plate-like pin portion 31, a first fixing portion 32, a flexible connecting portion 33, a second fixing portion 34 and a terminal-contacting portion 35. Each pin portion 31 has a needle-eye type hole 311. The first fixing portion 32 is connected to the pin portion 31. The connecting portion 33 is situated between the first fixing portion 32 and the second fixing portion 34. The terminal-contacting portion 35 is connected to the end of the second fixing portion 34 away from the connecting portion 33. The first fixing portion 32, the connecting portion 33, the second fixing portion 34 and the terminal-contacting portion 35 are forming a rod-like shape. The outer diameter of the connecting portion 33 is smaller than those of the first fixing portion 32 and the second fixing portion 34.

Figure 3:
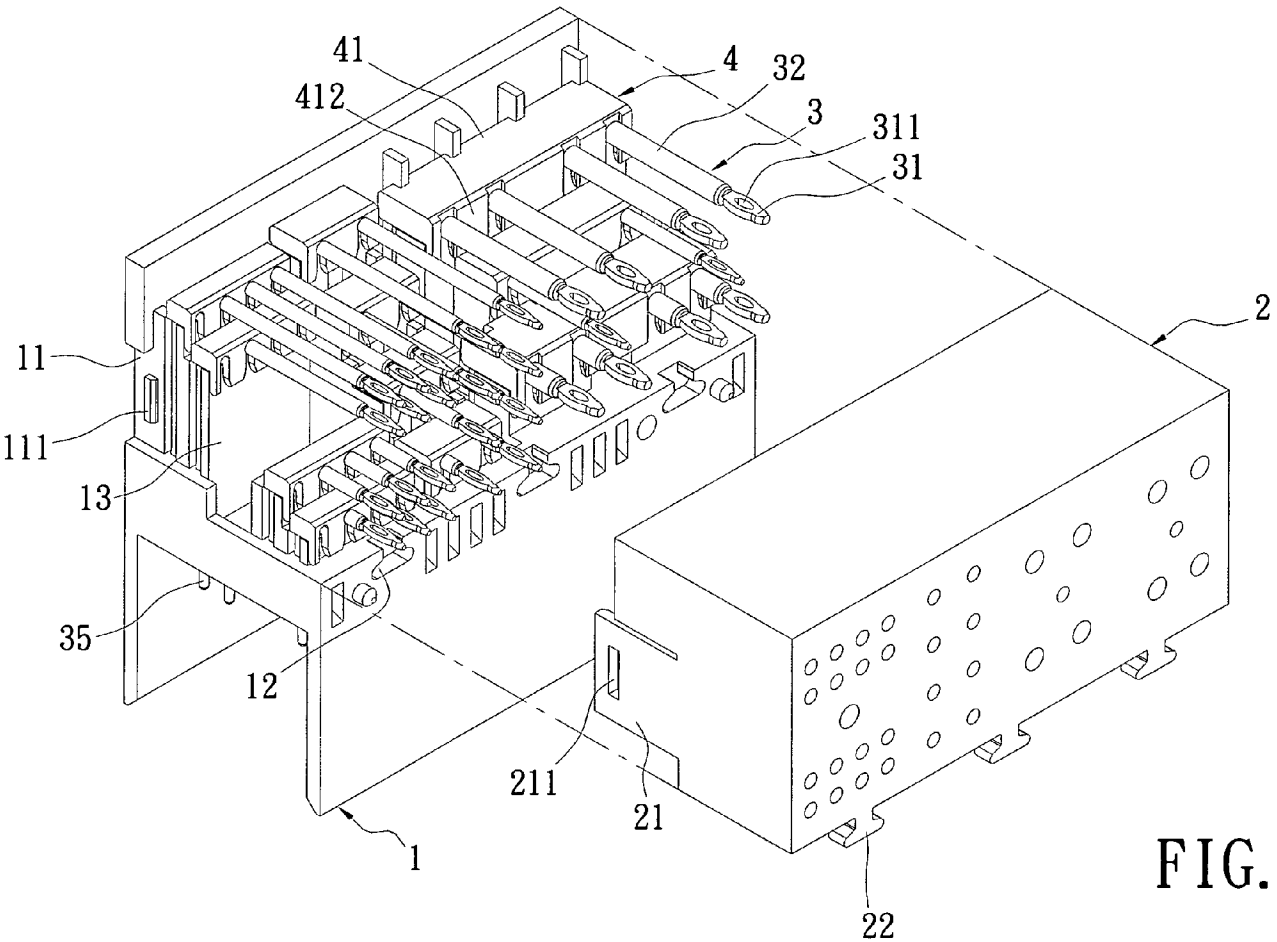
FIG. 3 is an exploded perspective view of the present invention.
Figure 4:
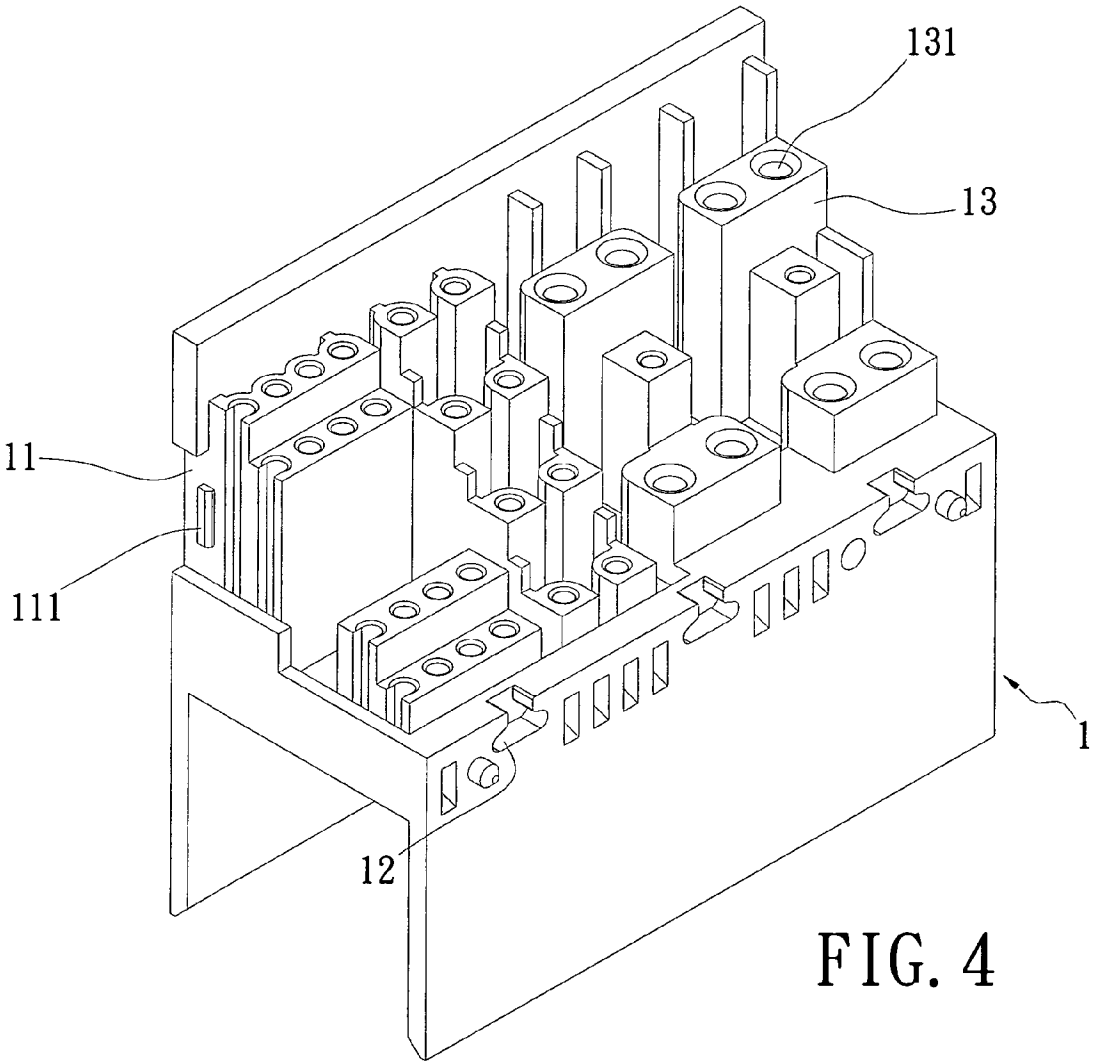
FIG. 4 is a perspective view showing the first cover of the present invention.
Figure 5:
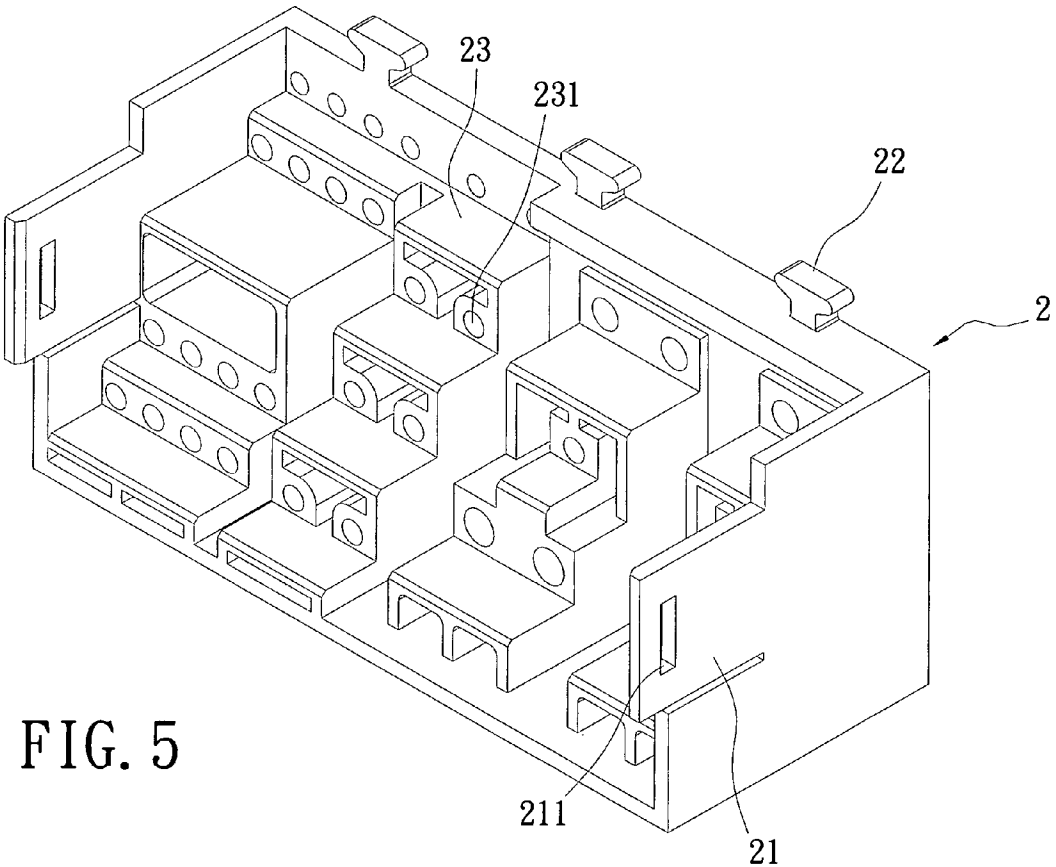
FIG. 5 is a perspective view showing the second cover of the present invention.

As shown in FIGS. 3 and 6, each terminal 3 is inserted in the first terminal-accommodating hole 131. The second fixing portion 34 is fixed in the first terminal-accommodating hole 131. The terminal-contacting portion 35 extends beyond one end of the first terminal-accommodating hole 131. The pin portion 31, the first fixing portion 32 and the connecting portion 33 extend beyond the other end of the first terminal-accommodating hole 131.

Figure 7:
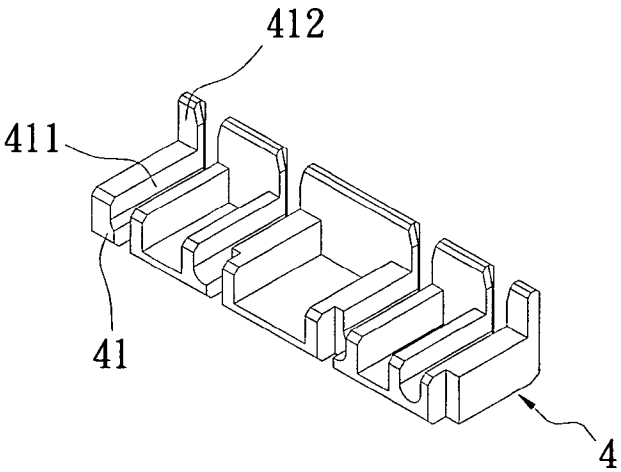
FIG. 7 is a perspective view showing the terminal-protecting piece of the present invention.

As shown in FIG. 7, the terminal-protecting pieces 4 are provided between the first terminals holders 13 and the second terminal holders 23. The terminal-protecting pieces 4 are provided on each terminal 3 (FIG. 3). The terminal-protecting piece 4 has a body 41. The lower surface of the body 41 is provided at intervals with a plurality of U-shaped grooves 411. A plurality of stoppers 412 is formed at intervals by means of bending and extending one side of the body 41. The groove 411 extends from one end of the body 41 adjacent to the stopper 412 to the other opposing end of the body 41. The connecting portion 33 of each terminal 3 is accommodated in the groove 411. The first fixing portion 32 and the pin portion 31 of the terminal 3 extend beyond the terminal-protecting piece 4 respectively. The lower surface of the body 41 and the inside of the stoppers 412 abut against the neighboring two end faces of the first terminal holder 13. The upper surface of the body 41 and the outside of the stoppers 412 abut against the neighboring two end faces of the second terminal holders 23.

The protruding point 111 of the engaging portion 11 is engaged into the rectangular hole 211 of the latch 21. The protrusions 22 of the second cover 2 are locked into the cavities 12 of the first cover 1. The first fixing portion 32 of the terminal 3 is fixed in the second terminal-accommodating hole 231. The pin portion 31 of terminal 3 extends beyond the second terminal-accommodating hole 231.

According to the improved pluggable insulated terminal block of the present invention, the terminals 3 will not be pushed inside the terminal block 10 upon insertion into the circuit board because the pushing force exerted by the circuit board will be transmitted through the terminal-protecting pieces 4 into the first cover 1 of terminal block 10. Thus, the production yield for the circuit board assembly can be improved.

Although the present invention has been described with reference to the foregoing preferred embodiment, it will be understood that the invention is not limited to the details thereof. Various equivalent variations and modifications can occur to those skilled in this art in view of the teachings of the present invention. Thus, all such variations and equivalent modifications are embraced within the scope of the invention as defined in the appended claims.

What is claimed is:

1. An improved pluggable insulated terminal block, comprising:

a terminal block comprising a first cover, a second cover and a plurality of terminals, an inner wall of the first cover being provided with a plurality of first terminal holders, each first terminal holder being provided with a plurality of first terminal-accommodating through holes, an inner wall of the second cover being provided with a plurality of second terminal holders, each second terminal holder being provided with a plurality of second terminal-accommodating through holes, the second terminal holders corresponding to the first terminal holders, each terminal penetrating through the first terminal-accommodating through hole and the second terminal-accommodating through hole, the first cover being connected with the second cover; and a plurality of terminal-protecting pieces, the terminal-protecting pieces being provided between the first terminal holders and the second terminal holders, the terminal-protecting pieces being arranged on the terminals, the two ends of the terminals extending beyond the terminal-protecting pieces.

2. The improved pluggable insulated terminal block according to claim 1, wherein the terminal-protecting piece comprises a body and a plurality of stoppers, a lower surface of the body is provided with a plurality of grooves, the stoppers are formed at intervals by means of bending and extending from one side of the body, the grooves extend from the end of the lower surface of the body adjacent to the stoppers to the other opposing end of the lower surface of the body.

3. The improved pluggable insulated terminal block according to claim 2, wherein the terminal comprises a pin portion, a first fixing portion, a flexible connecting portion, a second fixing portion and a terminal-contacting portion, the first fixing portion is connected to the pin portion, the first fixing portion is fixed to the second terminal-accommodating through hole, the connecting portion is located between the first fixing portion and the second fixing portion, the terminal-contacting portion is connected to one end of the second fixing portion away from the connecting portion, the outer diameter of the connecting portion is smaller than those of the first fixing portion and the second fixing portion, the second fixing portion is fixed to the first terminal-accommodating through hole, the connecting portion is accommodated in a groove of the terminal-protecting piece, the first fixing portion and the pin portion extend beyond each pair of the stoppers.

4. The improved pluggable insulated terminal block according to claim 2, wherein the grooves of the terminal-protecting piece are U-shaped.

5. The improved pluggable insulated terminal block according to claim 2, wherein the lower surface of the body and the inside of the stoppers abut against the neighboring two end faces of the first terminal holder, and the upper surface of the body and the outside of the stoppers abut against the neighboring two end faces of the second terminal holder.

* * * * *